US006440346B1

(12) United States Patent
Wai et al.

(10) Patent No.: US 6,440,346 B1
(45) Date of Patent: Aug. 27, 2002

(54) METHOD FOR MAKING GOLF BALL

(75) Inventors: Martin P. Wai, Carlsbad; David L. Felker, Bonsall; William Priest, Carlsbad, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/389,799

(22) Filed: Sep. 3, 1999

Related U.S. Application Data

(62) Division of application No. 09/137,406, filed on Aug. 20, 1998, now Pat. No. 5,984,807.

(51) Int. Cl.[7] ..... B29C 45/14

(52) U.S. Cl. ..... 264/254; 264/255; 264/267; 264/273; 264/274; 264/275; 264/279.1

(58) Field of Search ..... 264/250, 274, 264/275, 279.1, 325, 255, 254, 273, 267; 475/116

(56) References Cited

U.S. PATENT DOCUMENTS 5,692,973 A * 12/1997 Dalton ..... 473/374
5,820,485 A * 10/1998 Hwang ..... 473/361
5,836,834 A * 11/1998 Mastani et al. ..... 473/374
6,039,910 A * 3/2000 Tanaka et al. ..... 264/248
6,103,166 A * 8/2000 Boehm et al. ..... 264/250

* cited by examiner

*Primary Examiner*—Jan H. Silbaugh
*Assistant Examiner*—Edmund H. Lee
(74) *Attorney, Agent, or Firm*—Michael A. Catania

(57) ABSTRACT

A geometric-shaped core (12) for a golf ball (10) has a plurality of outwardly extending projections (14) formed on a spherical central portion thereof. A layer (22) of a relatively less resilient material is applied in the interstitial space between the projections (14) on the surface of the core (12), and a cover (24) is applied over the core (12) and interstitial layer (22). The geometric-shaped core (12) is manufactured by first providing flexible, resilient, honeycombed inserts (42) to be used in a conventional compression mold (30). The inserts (42) are placed into the upper and lower mold cavities (30), the core material (40) is added, and the geometric-shaped golf ball core (12) is compression molded.

5 Claims, 5 Drawing Sheets

METHOD FOR MAKING GOLF BALL

CROSS REFERENCES TO RELATED APPLICATIONS

This application is a divisional application of co-pending U.S. patent application Ser. No. 09/137,406 which was filed on Aug. 20,1998 now U.S. Pat. No. 5,984,807.

STATEMENT REGARDING FEDERALLY SPONSORED RESEARCH OR DEVELOPMENT

Not Applicable

BACKGROUND OF THE INVENTION

1. Field of the Invention

The present invention relates to solid golf balls having a core and a cover covering the core. More particularly, the present invention relates to an improved golf ball core construction for use in solid golf balls.

2. Description of the Related Art

Golf balls are generally classified as one of two construction types: wound construction and solid construction. Wound balls typically contain a solid or liquid center, elastomeric thread windings about the center, and a cover. Solid balls typically contain a solid polymeric core and a separately formed cover. Additional polymeric layers optionally may be interposed as intermediate layers between the center or core and the characteristics. It is generally understood in the art that solid balls may provide better initial velocity, distance and durability than wound balls, while wound balls may provide better feel and control than solid balls.

Due to the perceived inadequacy in terms of control and feel of some solid balls relative to wound balls, the art has proposed several modifications of conventional solid ball materials and construction in order to provide playability characteristics more closely resembling or even exceeding those of wound balls, while still retaining the preferred characteristics found in solid bails. Some of these proposed modifications include providing softer materials in the core, and adding a relatively soft intermediate or mantle layer over a conventional hard polybutadiene core. See, for example, U.S. Pat. No. 5,556,098. While these proposed modifications are directed to achieving better feel and control in a solid ball, they generally do so through a compromise of the distance and durability otherwise found in the unmodified solid ball. There therefore continues to exist a need for a golf ball construction type that optimizes the various performance characteristics such as durability, distance, initial velocity, control, and feel.

In terms of core materials for use in conventional solid ball construction, solid cores are typically compression molded from a slug of uncured or lightly cured elastomer composition comprising a high cis content polybutadiene and a metal salt of an a, ethylenically unsaturated carboxylic acid such as zinc mono or diacrylate or methacrylate. To achieve higher coefficients of restitution in the core or to increase core weight, the manufacturer may include a small amount of a metal oxide such as zinc or calcium oxide. Other materials used in the core composition include compatible rubbers or ionomers, and low molecular weight fatty acids such as stearic acid. Free radical initiator catalysts such as peroxides are admixed with the core composition so that on the application of heat and pressure, a complex curing or cross-linking reaction occurs.

In terms of core geometry in solid ball construction, the prior art generally teaches the use of a smooth spherical core for use in conventional solid golf balls. The spherical core construction has heretofore been believed to provide adequate performance while at the same time being the most efficient shape for use in conventional golf ball manufacturing processes. There have been variations proposed, however, such as in U.S. Pat. No. 4,229,401 and related U.S. Pat. No. 4,173,345, in which the inventors disclose a core having a series of narrow shallow surface channels each lying on great circles passing through opposite pole areas of the core. The purpose of the surface channels is to prevent the formation of air pockets between the core and cover when the cover is molded onto the core. Similarly, in U.S. Pat. No. 1,558,706, the inventors disclose a core having a surface roughened by corrugations to prevent relative movement of the cover on the core during use of the ball. In U.S. Pat. No. 698,516, there is shown a gutta-percha core (A) having indentations or perforations formed thereon, and a celluloid casing (B) formed over the core. The purpose of the indentations or perforations is to "key" the celluloid casing upon the gutta-percha shell. Finally, in U.S. Pat. No. 743,105, the inventors disclose a golf ball in which the inner surface of the cover and outer surface of the core are each provided with matching projections to give the ball an improved resilient action when struck by a club. Due to the nature of these previously proposed golf ball core modifications, none is directed to improving the control and feel of a solid golf ball; they are instead directed to, respectively, improved manufacturing ability, durability, and resilience.

There therefore continues to exists a need for a golf ball that provides the distance and durability of a solid ball construction, while at the same time providing the control and feel similar to that provided by a wound ball.

BRIEF SUMMARY OF THE INVENTION

The present invention is described with great clarity and definition in the detailed description following this summary and the appended claims. However, for the purpose of summarizing, the present invention is directed to a golf ball having the preferred initial velocity, distance, and durability of a solid golf ball, while obtaining the preferred control and feel of a wound ball. This result is achieved by the provision of a relatively hard, resilient solid golf ball core having a modified external surface comprising a plurality of raised projections. An interstitial layer of relatively soft, less resilient material is applied such that it fills the interstitial space between the projections on the core, and a cover covers the core and interstitial layer. One or more intermediate layers may optionally be interposed between the cover and core to obtain desired performance benefits.

The core construction described herein is believed to provide significant benefits over the conventional spherical solid cores of the prior art. For example, the provision of a relatively soft, less resilient interstitial layer on a relatively hard, resilient core is believed to provide a golf ball that combines the distance and durability of a conventional solid golf ball with improved feel and control. The materials used in the core and interstitial layer, as well as the height, width, and orientation of the projections on the core may be varied to optimize these benefits. In one preferred embodiment, the projections are sized and distributed so as to equate the volume of the projections with the volume of the interstitial layer. In another preferred embodiment, the projections are sized and distributed so as to equate the outer surface area of the projections with the outer surface area of the interstitial layer.

It is thus an object of this invention to provide a solid golf ball having improved durability, distance, control and feel.

It is a further object of this invention to provide a core for a solid golf ball having physical design parameters capable of being varied to obtain desired performance characteristics.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Turning to FIGS. 1A through 1C and FIG. 2, a geometric-shaped core 10 for a solid golf ball is shown. The geometric-shaped core includes a central portion 12 having a plurality of projections 14 formed integrally with and extending radially outwardly from the central portion 12 of the core 10. Though the central portion 12 of the core is shown in the FIGS. to be a Single body, the central portion 12 may optionally comprise two or more layers, provided that the outermost layer of the core has the projections 14 shown in the Figures. In one such alternative embodiment, the center of the central portion 12 may comprise a hollow center or fluid filled center having an outer casing layer with projections.

Figure 1A:
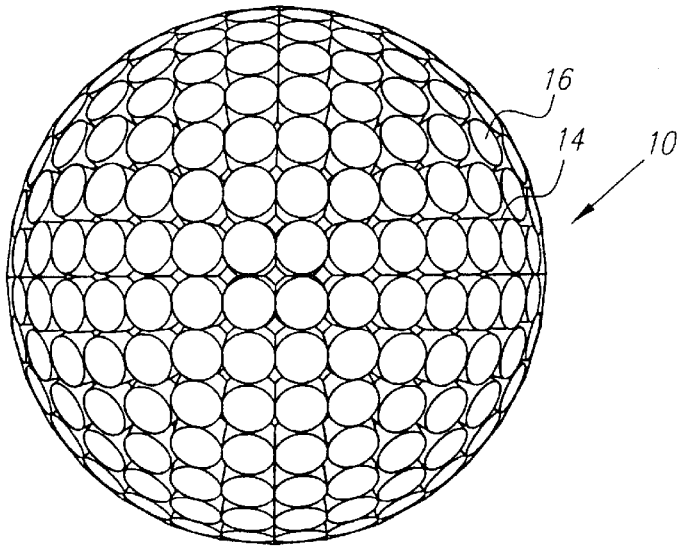
FIG. 1A is a plan view of a-geometric-shaped golf ball core according to one preferred form of the present invention.
Figure 1B:
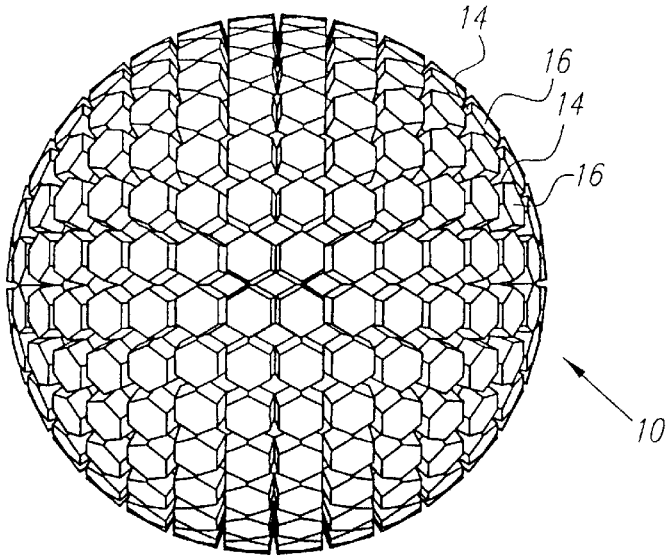
FIG. 1B is a plan view of a geometric-shaped golf ball core according to a further preferred form of the present invention.
Figure 1C:
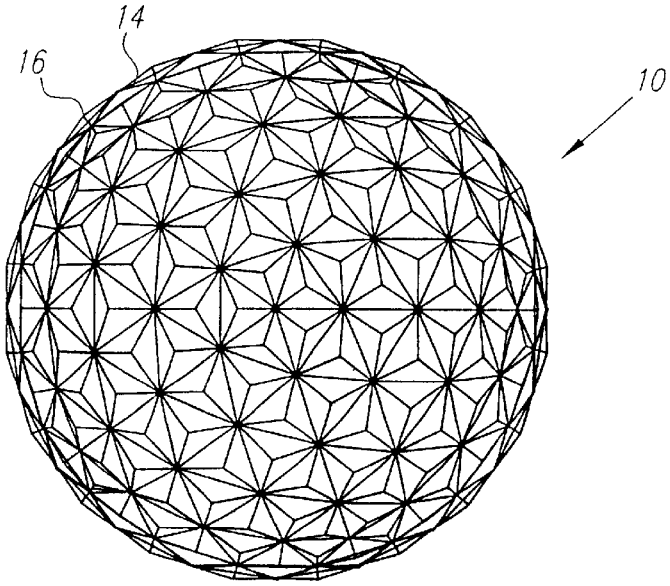
FIG. 1C is a plan view of a geometric-shaped golf ball core according to a still further preferred form of the present invention.

Each projection has an outwardly facing top surface 16 at its end opposite the central portion 12. The top surface 16 may be provided in an infinite number of regular or irregular geometric shapes, such as circular, triangular, square, rectangular, pentagonal, or the like. Two such possible shapes are shown in FIGS. 1A and 1B: In FIG. 1A, the top surface 16 is provided with a circular shape; in FIG. 1B, the top surface 16 is provided with a hexagonal shape. Though not shown in the FIGS., irregular or random shapes are also possible for the top surfaces 16 of the projections 14. In FIG. 1C, each projection 14 is formed as a cone or an apex, such that the top surface 16 is effectively a point.

Figure 2:
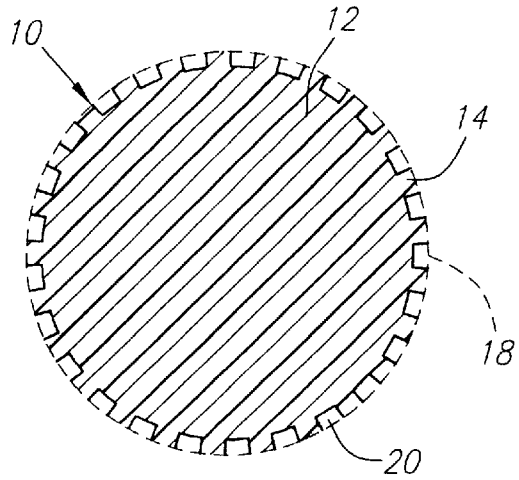
FIG. 2 is a cross-sectional view of the geometric-shaped golf ball core of FIG. 1A.

As best shown in FIG. 2, the top surface 16 of each projection 14 is preferably rounded in cross-section, such that the top surfaces 16 of the plurality of projections 14 together define a non-continuous sphere 18 spaced radially outward from the central portion 12 of the core. Depending on the sizes and shapes of the projections 14, the top surface 16 of each projection will have a given surface area $S_p$. and the aggregate of the surface areas of the top surfaces 16 of the plurality of projections 14 may be defined as $S_{AP}$. By definition, the aggregate surface area $S_{AP}$ of the top surfaces 16 of the projections 14 will be some fraction of the surface area $S_S$ of the non-continuous sphere 18. Once again, depending on the sizes and shapes of the projections 14, the projection aggregate surface area $S_{AP}$ may comprise from 1% to 99% of the surface area $S_S$ of the non-continuous sphere 18.

The plurality of projections 14 together define an interstitial space 20 located between adjacent projections 14 and between the non-continuous sphere 18 and the central portion 12 of the core. As those skilled in the art will recognize, the volume of the interstitial space 20 will depend on the geometry of the geometric-shaped core 10, including the radius of the central portion 12 of the core, the radius of the non-continuous sphere 18, and the aggregate volume of the projections 14 formed on the core. As described below, the volume of the interstitial space 20 provides a design parameter that may be varied by the manufacturer in order to obtain desired performance characteristics. A further design parameter is provided by the outer surface area of the projections, which is the aggregate of the surface areas of the top surfaces 16 of the plurality of projections 14.

In the preferred embodiment, the geometric-shaped core 10 comprises a hard, resilient rubber material comprising a base rubber, a co-crosslinking agent and a free radical initiator. The hardness of the core 10 is preferably between 40 to 65 Shore D, with the most preferred core formulation having a hardness of between 48 to 55 Shore D. The-base rubber may be polybutadiene, preferably 1,4-cis-polybutadiene rubber having a cis content of 90% or more, most preferably 98% or more. The co-crosslinking agent is preferably a zinc or magnesium salt of an unsaturated fatty acid, such as methacrylic acid or acrylic acid. Zinc diacrylate is preferred. The co-crosslinking agent is blended in amounts of about 10 to 27 parts by weight of the base rubber. The free radical initiator is preferably a peroxide selected from a variety of peroxides, such as 1,1,-bis(t-butylperoxy)-3,3,5-trimethylcyclohexane (Trigonox® 29/40) and mixtures of dicumyl peroxide and 1,1,-bis(t-butylperoxy)-3,3,5-trimethylcyclohexane. The peroxide is blended in amounts of about 0.5 to 1 parts by weight per 100 parts by weight of the base rubber. If desired, fillers such as zinc oxide and barium sulfate may be blended in the rubber composition.

The size of the geometric-shaped core 10 is generally similar to the size of solid cores used in conventional solid golf balls. For example, for a golf ball having an outside diameter of the USGA minimum limit of 1.68", the outside diameter of the geometric-shaped core 10, including the projections 14, is preferably within the range of 0.5" to 1.64", and most preferably between 1.50" to 1.58". At diameters less than 0.5", it is believed that the benefits of using the geometric-shaped core construction are de minimis. At diameters larger than 1.64", it is not possible to apply a cover to the core while still remaining within a 1.68" overall ball diameter limit. Those skilled in the art will recognize, however, that geometric-shaped cores having diameters larger than 1.64" may be used in oversized balls larger than 1.68" in diameter.

Figure 3:
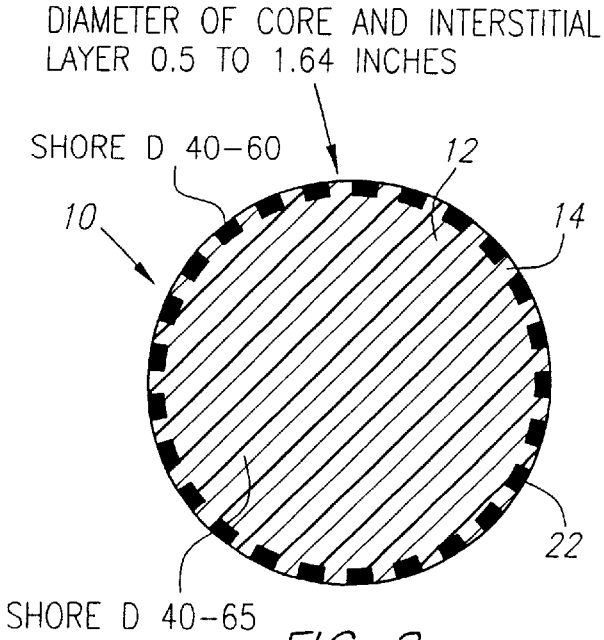
FIG. 3 is a cross-sectional view of the geometric-shaped golf ball core of FIG. 1A having an interstitial layer.

Turning now to FIG. 3, in a preferred embodiment, an interstitial layer 22 is provided in the interstitial space defined above. The interstitial layer 22 preferably comprises a material or materials that are relatively softer and less resilient than the material used to make up the core 10. The hardness of the interstitial layer is preferably between 40 to 60 Shore D, with the most preferred interstitial layer formulation having a hardness of between 45 to 53 Shore D. For example, the interstitial layer 22 may comprise one or more polymer materials, such as thermoset rubber, plastic, or 5 thermoplastic elastomeric materials. Several non-limiting examples of thermoset rubber materials suitable for use as the interstitial layer include polybutadiene rubber, polyisoprene rubber, natural balata, synthetic balata, styrene butadiene, urethane rubber, polydimethylsiloxane, or blends thereof. Several non-limiting examples of plastic materials suitable for use as the interstitial layer include polypropylene, polycarbonate, thermoplastic urethane (TPU), thermoplastic elastomer (TPE), or blends thereof. Several non-limiting examples of thermoplastic elastomeric materials suitable for use as the interstitial layer include copolymers of methyl-methacrylate with butadiene and styrene, copolymers of methyl-acrylate with butadiene and styrene, acrylonitrile styrene copolymers, polyesters, polyethers, polyetheresters, polyether-amides, polyurethanes, ionomers, or blends thereof. In a preferred form, the interstitial layer 22 comprises polyurethane. Those skilled in the art will recognize that these materials are for exemplary purposes only, and that other and further materials may be used for the interstitial layer in keeping with the scope of the present invention.

Figure 4:
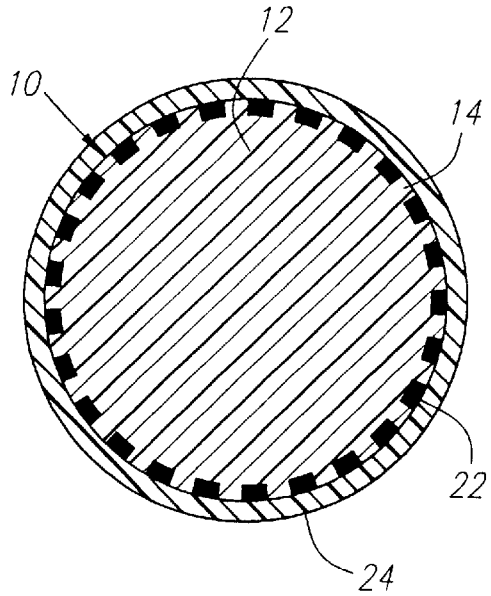
FIG. 4 is a cross-sectional view of the geometric-shaped golf ball core and interstitial layer of FIG. 3 having a cover.

As shown in FIG. 4, a cover 24 may be formed around the core 10 and interstitial layer 22. The cover may comprise any of a number of materials known to be useful as golf ball cover materials to those skilled in the art, such as balata, ionomer polyurethane, and the like. In a preferred form, the cover 24 comprises one or more of the ionomeric resins manufactured by E.I. DuPont de Nemours under the trademark Surlyn®. A plurality of dimples (not shown) are preferably formed on the exterior surface of the cover 24. The cover 24 may be either compression or injection molded around the core 10 and interstitial layer 22 in a manner known to those skilled in the art. Injection molding is preferred.

Figure 5:
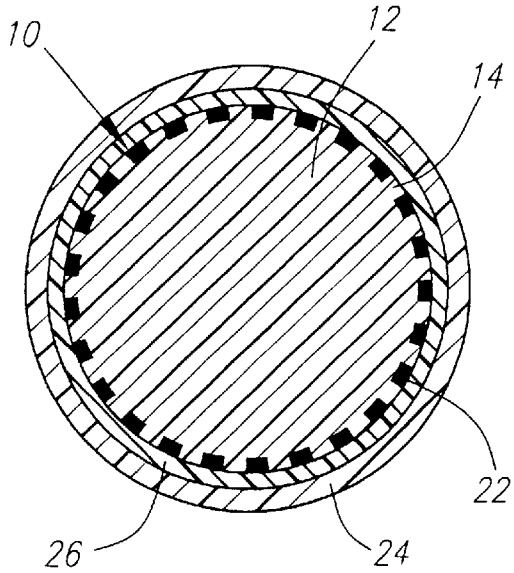
FIG. 5 is a cross-sectional view of the geometric-shaped golf ball core and interstitial layer of FIG. 3 having an intermediate layer and a cover.

In FIG. 5, an alternative embodiment is shown in which an intermediate layer 26 is interposed between the cover 24 and the core 10 and interstitial layer 22. The intermediate layer 26 may comprise any one or more of a number of rubber or polymeric materials known to be useful as golf ball intermediate layers to those skilled in the art, such as diene rubber blends, ionomers or ionomer blends, polyurethanes, or the like. In a preferred form, the intermediate layer 26 comprises polyurethane. Though one intermediate layer 26 is shown in FIG. 5, it is possible to provide two or more intermediate layers in order to provide additional design parameters to obtain desired performance characteristics. The materials used for the two or more intermediate layers include those described above. Turning once again to FIGS. 1A–1C and FIG. 2, the projections 14 may be distributed over the surface of the core 10 in a relatively dense pattern in which adjacent projections 14 are in relatively close proximity to one another (relatively small volume of interstitial space 20 between adjacent projections 14), or in a relatively sparse pattern in which adjacent projections 14 are not in relatively close proximity to one another (relatively large volume of interstitial space 20 between adjacent projections 14). However, the projections 14 are preferably distributed uniformly over the surface of the core 10 in order to provide a symmetrical core with respect to impact of the finished golf ball by a golf club or the like. In other words, it is preferred that the projections 14 be distributed on the core 10 in a pattern that is sufficiently dense that the performance of the finished ball does not vary based upon the location of the area of impact between the finished ball and the golf club.

Figure 6:
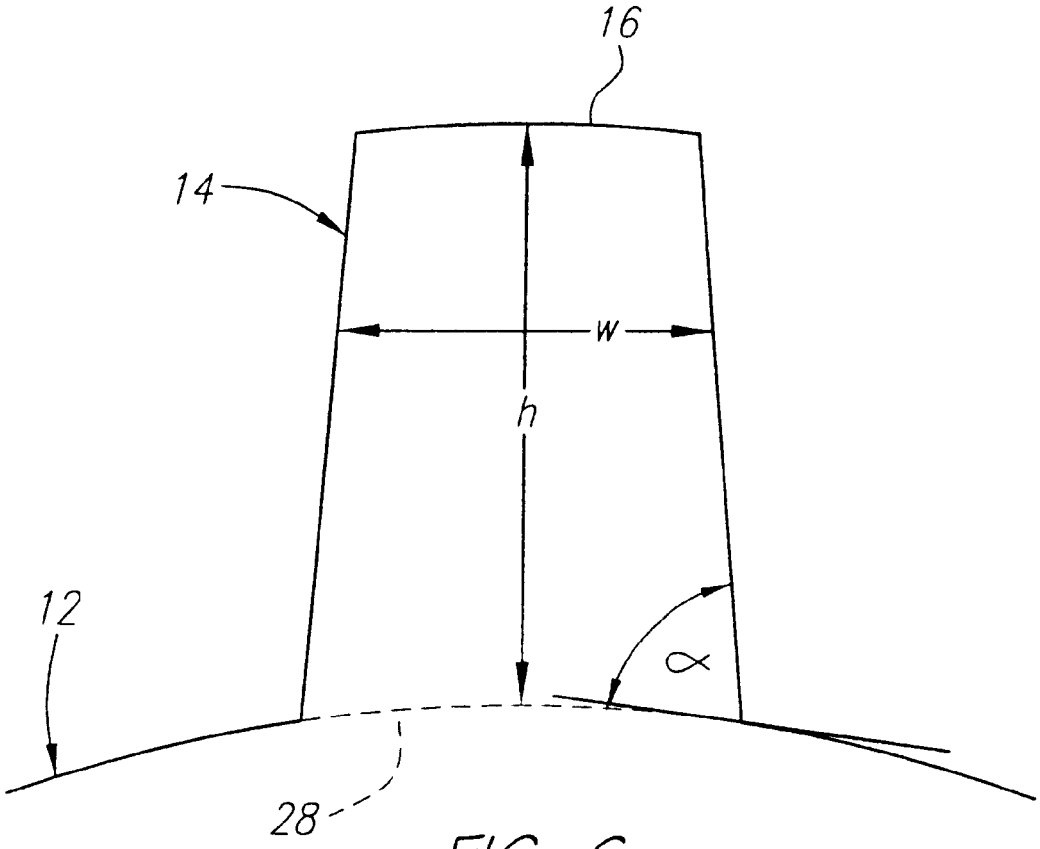
FIG. 6 is a cross-sectional view of a projection of the geometric-shaped golf ball core of FIG. 1A.

As best shown in the cross-sectional illustration of a single projection 14 in FIG. 6, a projection 14 may be characterized by a number of geometric parameters to define its cross-sectional shape and orientation. For example, the height of the projection 14 relative to the central portion 12 of the core 10 is represented by the distance h, the width of the projection 14 at a given height is represented by the distance w, and the wall angle of the projection relative to an imaginary tangent to the central portion 12 of the core is represented as a. Accordingly, in addition to the shape of the top surface of each projection 14, the height h, width w, and wall angle a of each projection 14 may be varied to obtain desired performance characteristics of the finished golf ball.

A projection volume, $V_P$, is defined as the volume occupied by the projection above the imaginary line 28 shown in FIG. 6 separating the central portion 12 from the projection 14. A given distribution pattern of projections 14 of given sizes and shapes on a geometric-shaped core 10 will possess an aggregate projection volume, $V_{AP}$, defined as the sum of the volumes, $V_P$, of each projection 14 formed on the geometric- shaped core 10. Conversely, an interstitial layer volume, $V_{IL}$, may be defined as the aggregate volume of the interstitial space between the projections 14, outside the central portion 12 of the core, and within the non-continuous sphere 18.

In a preferred form, the projections 14 are designed of sufficient sizes, shapes and distribution such that the aggregate projection volume $V_{AP}$ is generally equal to the volume of the interstitial layer $V_{IL}$. In other words, the plurality of projections 14 together preferably occupy about one-half of the volume between the central portion 12 of the core and the non-continuous sphere 18, while the interstitial layer occupies the other half of the specified volume. Accordingly, the projections 14 comprising a hard, resilient material will contribute to the performance of the finished golf ball in terms of distance and durability, while the softer, less resilient interstitial layer 22 will contribute to the performance of the finished golf ball in terms of feel and control. By altering the relative volumes, $V_{AP}$ and $V_{IL}$, it is possible to vary the performance characteristics of the ball to achieve desired results.

It is believed that the finished golf ball containing the geometric-shaped core 10 and construction described herein will provide desirable performance benefits not heretofore possible with conventional spherical cores and construction types. For example, a finished ball containing the geometric-shaped core is believed to be capable of providing the durability and distance of a conventional solid golf ball, while providing improved control and feel. As another example, the variability of shapes, sizes and distribution of the projections on the geometric-shaped core provide additional parameters for the golf ball designer to vary in order to achieve desired performance characteristics. As a still further example, the golf ball designer may vary the specific gravity of the material used in the interstitial layer on the geometric-shaped core in order to achieve still further desirable performance characteristics through manipulation of the moment of inertia of the golf ball. Those skilled in the art will recognize that other and further performance benefits are made available through use of the geometric-shaped core and construction type of the golf balls of the present invention.

Turning now to FIGS. 7 through 10, methods of manufacturing the geometric-shaped golf ball core will be described. In a preferred method, mold inserts are provided for use with a conventional compression mold for molding the geometric-shaped golf ball core. The mold inserts are constructed having a shape and of a material that allows the inserts, in conjunction with the mold, to mold the golf ball core into the geometric-shaped shape described above.

Figure 7:
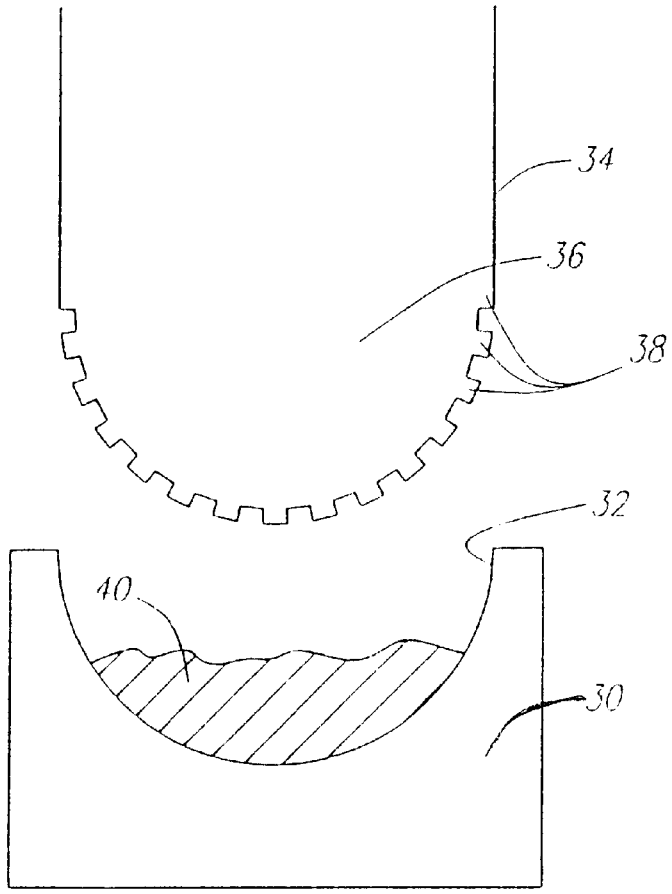
FIG. 7 is a cross-sectional view of a mold cavity and plunger according to a preferred form of the present invention.

Turning first to FIG. 7, there is shown in cross-section a mold cavity 30 having a smooth hemispherical internal surface 32 and a mating plunger 34. The mold cavity 30 may be of a conventional type for molding solid golf ball cores, and has an internal diameter chosen based upon the desired diameter of the golf ball core. As noted above, this diameter will preferably range from 0.5" to 1.64" for a finished ball having a diameter of about 1.68". The plunger 34 comprises a tool having a hemispherical head portion 36 with a plurality of protrusions 38 formed on its external surface. The hemispherical head 36 and protrusions 38 are arranged on the plunger to have sizes, shapes and distribution matching the desired sizes, shapes and distribution of the projections 14 to be formed on the resultant geometric-shaped golf ball core 10.

To make an insert for use in the present method, a quantity of insert material 40 is first placed into the mold cavity 30. Once the insert material 40 is placed in the mold cavity 30, the plunger 34 is advanced into the mold cavity 30 until the protrusions 38 contact the internal surface 32 of the mold cavity. This causes the insert material 40 to be pressed into the spaces between the protrusions 38 formed on the plunger 34. The insert material 40 is then cured through the application of heat and/or pressure, and the plunger 34 removed from the mold cavity 30.

Because of the shape of the head portion 36 of the plunger, the insert will adhere to the head portion 36 when the plunger 34 is removed from the mold cavity. Once the plunger 34 is removed, the insert is peeled from the plunger. Accordingly, the material used for the insert must have sufficient flexibility and resiliency to allow it to be removed in such a manner from the plunger. In the preferred embodiment, the material to be used for the insert may comprise any thermoset or thermoplastic material having a combination of material properties such as melt point, flexural modulus, and hardness that are sufficient to allow the insert to perform as required. In a preferred form, the insert material comprises polyurethane.

Figure 8:
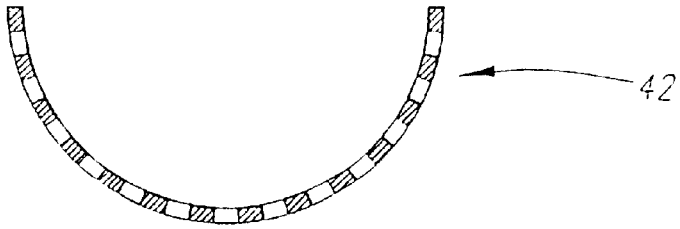
FIG. 8 is a cross-sectional view of a mold insert according to a preferred form of the present invention.

Turning now to FIG. 8, after removing the insert from the plunger, the insert 42 generally is in the form of a half-shell having a honeycomb structure that is the negative of the plunger 34. An insert 42 is then placed in each of an upper mold cavity and lower mold cavity (not shown in the FIGURES) for molding the geometric-shaped core. Because the insert 42 is constructed of a material having sufficient flexibility, resilience and melt point, the geometric-shaped core may be constructed by compression molding a slug of core material in a conventional manner known to those skilled in the art without melting or damaging the inserts. During the compression molding process, the core material will fill in the honeycomb structure of the two inserts to produce the desired geometric shaped shape of the core. At the conclusion of the compression molding process, the geometric shaped core is removed from the mold, the two inserts are removed from the upper and lower halves of the geometric-shaped core, and the geometric-shaped core is in condition for additional processing to manufacture a finished golf ball. In an alternative embodiment, the inserts 42 are not removed from the geometric-shaped core, but instead remain on the core to form the interstitial layer 22, thereby eliminating the need for a separate step of forming the interstitial layer 22 on the geometric-shaped core.

Figure 9:
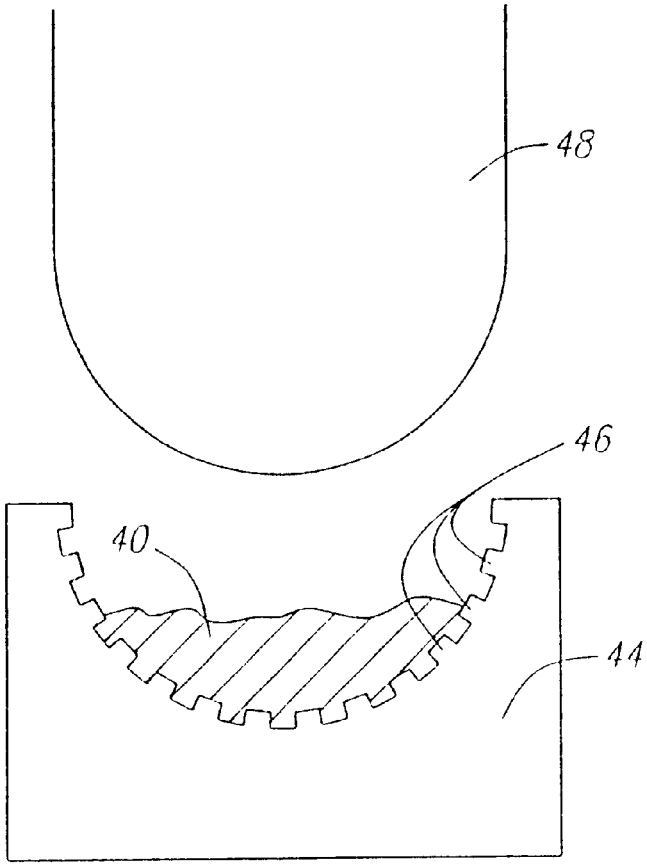
FIG. 9 is a cross-sectional view of a modified mold cavity and plunger according to a further preferred form of the present invention.
Figure 10A:
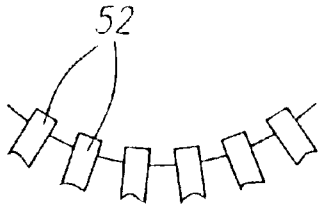
FIG. 10 is a cross-sectional view of a portion of the modified mold cavity of FIG. 9.
Figure 10B:
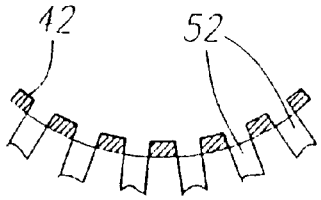

Turning now to FIG. 9, in an alternative method for manufacturing an insert, a modified mold cavity 44 is provided with an internal surface having a plurality of inward facing protrusions 46, and a smooth plunger 48 is provided. In this method, an amount of insert material 40 is placed in the modified mold cavity 44 and the smooth plunger 48 is then moved into the mold cavity to cause the insert material 40 to fill in the spaces between the protrusions 46 of the mold cavity. After curing, the plunger 48 is withdrawn and the insert peeled out of the mold cavity 44. To facilitate this method, the inward facing protrusions 46 of the mold cavity may optionally comprise retractable pins that are withdrawn from the mold cavity 44 after the insert 42 has been cured, as shown in FIGS.10A and 10B. The insert 42 produced by this alternative method may be constructed to have an identical shape to that provided in the above method. Though a cast system for making the inserts 42 is shown, those skilled in the art will recognize that the inserts may be constructed by alternative methods such as injection molding or other suitable alternatives in a manner and using equipment similar to that described above. From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for manufacturing a golf ball, the method comprising:

creating first half-shell insert and second half-shell insert, each half-shell insert composed of a thermoset or thermoplastic material, each half-shell insert having a honeycomb structure;

placing the first half-shell insert in a lower cavity of a compression mold and the second half-shell insert in an upper cavity of the compression mold;

placing a slug in the first half-shell insert which is in the lower cavity, the slug composed of a polybutadiene material;

compression molding the slug into a core having a central portion with a plurality of projections extending outward therefrom, each of the projections having a top whereby the first half-shell insert and the second half-shell insert form an interstitial layer between the central portion and the top of each of the plurality of projections; and injection molding a cover over the core and the interstitial layer, the cover composed of an ionomer material.

2. The method according to claim 1 wherein the interstitial layer has a shore D hardness less than the shore D hardness of the core.

3. The method according to claim 1, wherein the core and the interstitial layer have a diameter in the range of 0.5 to 1.64 inches.

4. A method for manufacturing a golf ball, the method comprising:

creating first half-shell insert and second half-shell insert, each half-shell insert composed of a thermoset or thermoplastic material, each half-shell insert having a honeycomb structure;

placing the first half-shell insert in a lower cavity of a compression mold and the second half-shell insert in an upper cavity of the compression mold;

placing a slug in the first half-shell insert which is in the lower cavity, the slug composed of a polybutadiene material;

compression molding the slug into a core having a central portion with a plurality of projections extending outward therefrom, each of the projections having a top, the core having a Shore D hardness ranging from 40 to 65;

removing the first half-shell insert and the second half-shell insert from the core to create an interstitial space defined by a surface of the central portion and the top of each of the projections;

filling the interstitial space with a polyurethane material to create an interstitial layer between the surface and the top of each of the plurality of projections, the interstitial layer having a Shore D hardness ranging from 40 to 60, and the Shore D hardness of the interstitial layer being lower than the Shore D hardness of the core; and injection molding a cover over the core and the interstitial layer, the cover composed of an ionomer material.

5. A method for manufacturing a golf ball, the method comprising:

creating first half-shell insert and second half-shell insert, each half-shell insert composed of a thermoset or thermoplastic material, each half-shell insert having a honeycomb structure;

placing the first half-shell insert in a lower cavity of a compression mold and the second half-shell insert in an upper cavity of the compression mold;

placing a slug in the first half-shell insert which is in the lower cavity, the slug composed of a polybutadiene material;

compression molding the slug into a core having a central portion with a plurality of projections extending outward therefrom, each of the projections having a top whereby the first half-shell insert and the second half-shell insert form an interstitial layer between the surface and the top of each of the plurality of projections;

molding an intermediate layer over the core and the interstitial layer, the intermediate layer formed of an ionomer material or a polyurethane material; and injection molding a cover over the intermediate layer, the cover composed of an ionomer material.

* * * * *